US009331387B2

(12) United States Patent
Chen et al.

(10) Patent No.: US 9,331,387 B2
(45) **Date of Patent: *May 3, 2016**

(54) WIDEBAND ANTENNA

(71) Applicant: MediaTek Inc., Hsin-Chu (TW)

(72) Inventors: Wei Yu Chen, New Taipei (TW); Shih-Wei Hsieh, Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 267 days.

This patent is subject to a terminal disclaimer.

(21) Appl. No.: 14/079,287

(22) Filed: Nov. 13, 2013

(65) Prior Publication Data

US 2014/0062796 A1 Mar. 6, 2014

Related U.S. Application Data

(63) Continuation-in-part of application No. 13/290,406, filed on Nov. 7, 2011, now Pat. No. 8,610,628.

(51) Int. Cl.

| | |
|---|---|
| ***H01Q 1/38*** | (2006.01) |
| ***H01Q 5/01*** | (2006.01) |
| ***H01Q 1/24*** | (2006.01) |
| ***H01Q 5/378*** | (2015.01) |

(52) U.S. Cl.

CPC ..... *H01Q 5/01* (2013.01); *H01Q 1/243* (2013.01); *H01Q 5/378* (2015.01)

(58) Field of Classification Search

CPC ..... H01Q 1/38; H01Q 1/243
USPC ..... 343/702, 700 MS
See application file for complete search history.

(56) References Cited

U.S. PATENT DOCUMENTS 6,952,187 B2 * 10/2005 Annamaa ..... H01Q 1/242 343/700 MS
6,963,310 B2 11/2005 Horita et al.

(Continued)

FOREIGN PATENT DOCUMENTS

CN 101944656 1/2011
CN 102055061 5/2011

(Continued)

OTHER PUBLICATIONS

Chang, C.H., et al.; "Coupled-Fed Planar M8-PIFA for Internal Mobile Phone Antenna;" Microwave and Optical Technology Letters; vol. 51; No. 6; Apr. 2009; pp. 1091-1096.

(Continued)

*Primary Examiner* — Hoanganh Le
(74) *Attorney, Agent, or Firm* — McClure, Qualey & Rodack, LLP

(57) ABSTRACT

A wideband antenna includes a first substrate, a second substrate, a ground plane, an exciting element, a connection element, a first branch, a second branch, and a coupling branch. The ground plane is disposed on the first substrate. The exciting element is disposed on the second substrate and has a feed point coupled to a signal source. The connection element is disposed on the second substrate and coupled to the ground plane. The first branch is disposed on the second substrate and coupled to the connection element. The second branch is disposed on the second substrate and coupled to the connection element. The coupling element is disposed on the second substrate and coupled to the connection element. The distance between the coupling element and the second branch is smaller than 5 mm.

20 Claims, 13 Drawing Sheets

(56) References Cited

U.S. PATENT DOCUMENTS

| | | | | |
|---|---|---|---|---|
| 7,113,133 | B2 | 9/2006 | Chen et al. | |
| 7,136,022 | B2 | 11/2006 | Sato et al. | |
| 7,183,980 | B2 | 2/2007 | Chang et al. | |
| 7,352,326 | B2 | 4/2008 | Korva et al. | |
| 7,659,853 | B2 | 2/2010 | Chen et al. | |
| 7,825,863 | B2 | 11/2010 | Martiskainen et al. | |
| 8,610,628 | B2 * | 12/2013 | Chen | H01Q 1/24 343/702 |
| 2002/0033772 | A1 * | 3/2002 | Johnson | H01Q 1/243 343/702 |
| 2002/0163473 | A1 * | 11/2002 | Koyama | G04G 21/04 343/700 MS |
| 2004/0090372 | A1 * | 5/2004 | Nallo | H01Q 1/243 343/700 MS |
| 2009/0153429 | A1 | 6/2009 | Su et al. | |
| 2010/0060528 | A1 | 3/2010 | Chiu et al. | |
| 2010/0328182 | A1 | 12/2010 | Wong et al. | |
| 2011/0095949 | A1 | 4/2011 | Wong et al. | |
| 2011/0102283 | A1 | 5/2011 | Chang et al. | |
| 2011/0156958 | A1 | 6/2011 | Wong et al. | |
| 2012/0032862 | A1 | 2/2012 | Ying | |

FOREIGN PATENT DOCUMENTS

| | | |
|---|---|---|
| CN | 102122751 | 7/2011 |
| DE | 102012 101 547 | 5/2013 |
| EP | 2 117 073 | 11/2009 |
| EP | 2 169 763 | 3/2010 |

OTHER PUBLICATIONS

Chang, C.H., et al.; "Coupled-Fed Small-Size PIFA for Penta-Band Folder-Type Mobile Phone Application;" Microwave and Optical Technology Letters; vol. 51; No. 1; Jan. 2009; pp. 18-23.

Chen, W.Y., et al.; "Small-Size Coupled-Fed Shorted T-Monopole for Internal WWAN Antenna in the Thin-Profile Mobile Phone;" Microwave and Optical Technology Letters; vol. 52; No. 2; Feb. 2010; pp. 257-262.

Chang, C.H., et al.; "Printed M8-PIFA for Penta-Band WWAN Operation in the Mobile Phone;" IEEE Transactions on Antennas and Propagation; vol. 57; No. 5; May 2009; pp. 1373-1381.

Kang, T.W., et al.; "Simple Small-Size Coupled-Fed Uniplanar PIFA for Multiband Clamsheel Mobile Phone Application;" Microwave and Optical Technology Letters; vol. 51; No. 2; Dec. 2009; pp. 2805-2810.

Lee, C.T., et al.; "Uniplanar Coupled-Fed Printed PIFA for WWAN/WLAN Operation in the Mobile Phone;" Microwave and Optical Technology Letters; vol. 51; No. 5' May 2009; pp. 1250-1257.

Ma, J., et al.; "Compact Planar Hexa-Band Inverted-F Antenna for Mobile Phone Application;" Microwave and Optical Technology Letters; vol. 53; No. 6; Jun. 2004; pp. 1233-1236.

Chen, S.C., et al.; "Planar Strip Monopole with a Chip-Capacitor-Loaded Loop Radiating Feed for LTE/WWAN Slim Mobile Phone Application;" Microwave and Optical Technology Letters; vol. 53; No. 4; Apr. 2011; pp. 952-958.

Tang, C.L.; "A Compact Coupled-fed Penta-band Antenna for Mobile Phone Application;" Proceedings of Asia-Pacific Microwave Conferece; 2010; pp. 2260-2263.

Lin, D.B.; "Interdigital Capacitor IFA for Multiband Operation in the Mobile Phone;" Progress in Electromagnetics Research C; vol. 15; 2010; pp. 1-12.

Wong, K.L., et al.; "Small-Size Loop Antenna with a Parasitic Shorted Strip Monopole for Internal WWAN Notebook Computer Antenna;" IEEE Transactions on Antennas and Propagation; vol. 59; No. 5; May 2011; pp. 1733-1738.

Wong, K.L., et al.; "Internal Eight-Band WWAN/LTE Handset Antenna Using Loop Shortening Strip and Chip-Capacitor-Loaded Feeding Strip for Bandwidth Enhancement;" Microwave and Optical Technology Letters; vol. 53; No. 6; pp. 1217-1222.

Wong, K.L., et al.; "Bandwidth-Enhanced Internal PIFA with a Coupling Feed for Quad-Band Operation in the Mobile Phone;" Microwave and Optical Technology Letters; vol. 50; No. 3; pp. 683-687.

Wong, K.L., et al.; "Wideband Surface-Mount Chip Antenna for Eight-Band LTE/WWAN Slim Mobile Phone Application;" Microwave and Optical Technology Letters; vol. 52; No. 11; Nov. 2010; pp. 2554-2560.

Wong, K.L., et al.; "Uniplanar Coupled-Fed Printed PIFA for WWAN Operation in the Laptop Computer;" Microwave and Optical Technology Letters; vol. 51; No. 2; Feb. 2009; pp. 549-554.

Wong, K.L., et al.; "Coupled-Fed Loop Antenna with Brand Radiators for Internal LTE/WWAN Laptop Computer Antenna;" Microwave and Optical Technology Letters; vol. 52; No. 12; Dec. 2010; pp. 2662-2667.

English language translation of abstract of CN 101944656 (published Jan. 12, 2011).

English language translation of abstract of CN 102055061 (published May 11, 2011).

English language translation of abstract of CN 102122751 (published Jul. 13, 2011).

* cited by examiner

WIDEBAND ANTENNA

CROSS REFERENCE TO RELATED APPLICATIONS

This application is a Continuation-In-Part of application Ser. No. 13/290,406, filed on Nov. 7, 2011, the entirety of which is incorporated by reference herein.

BACKGROUND OF THE INVENTION

1. Field of the Invention

The disclosure generally relates to a wideband antenna, and more particularly, relates to a wideband antenna covering 5 frequency bands, GSM (Global System for Mobile Communications) 850/900/1800/1900 and UMTS (Universal Mobile Telecommunications System).

2. Description of the Related Art

Nowadays, wireless networks are operated according to a wide variety of communication standards and/or in a wide range of frequency bands. In order to accommodate multiple frequency bands and/or multiple communication standards, many mobile communication devices include a wideband antenna that covers multiple frequency bands or include a different antenna for each frequency band. As manufacturers continue to design smaller mobile communication devices, the inclusion of multiple antennas in a mobile communication device has become increasingly impractical. Furthermore, while wideband antennas often cover multiple frequency bands, they typically do not cover all desired frequency bands.

BRIEF SUMMARY OF THE INVENTION

In one exemplary embodiment, the disclosure is directed to a wideband antenna, comprising: a first substrate; a second substrate; a ground plane, disposed on the first substrate; an exciting element, disposed on the second substrate, and having a feed point coupled to a signal source; a connection element, disposed on the second substrate, and coupled to the ground plane; a first branch, disposed on the second substrate, and coupled to the connection element; a second branch, disposed on the second substrate, and coupled to the connection element; and a coupling element, disposed on the second substrate, and coupled to the connection element, wherein a first distance between the coupling element and the second branch is smaller than 5 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
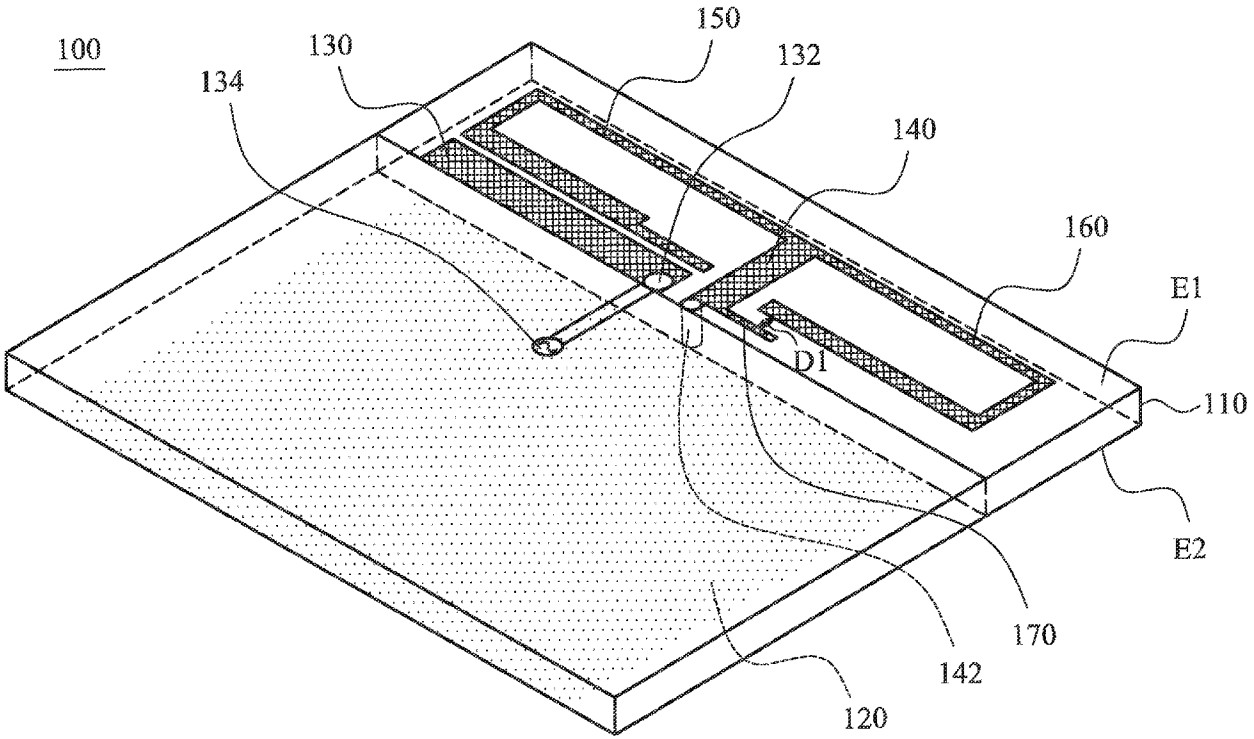
FIG. 1A is a pictorial drawing for illustrating a wideband antenna according to an embodiment of the invention.
Figure 1B:
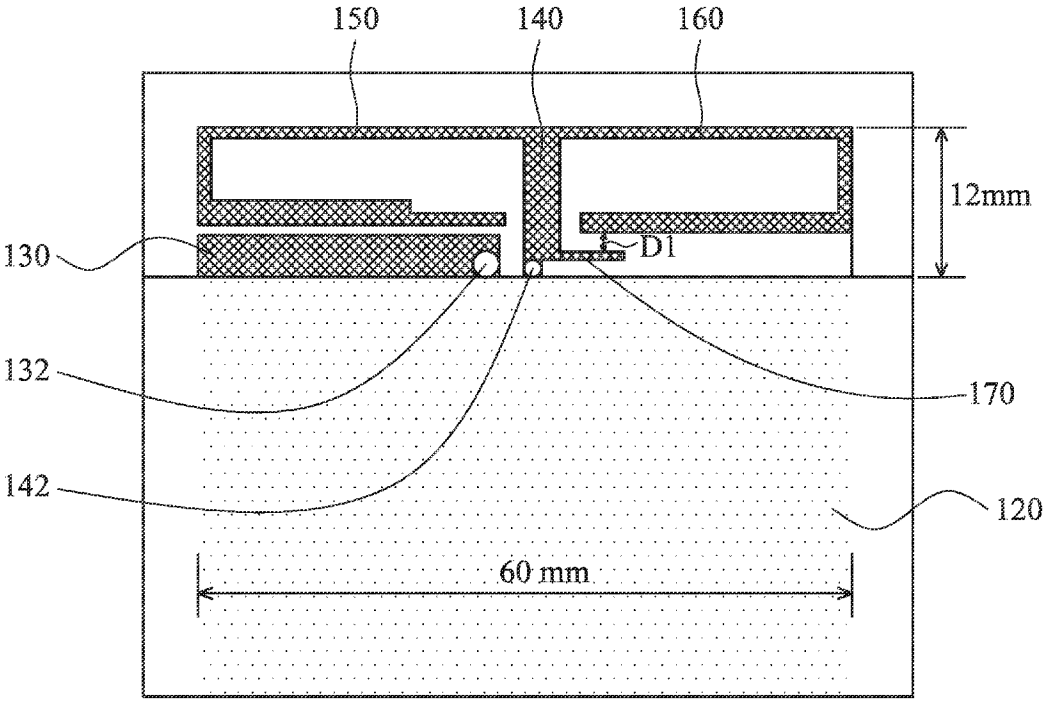
FIG. 1B is a vertical view drawing for illustrating the wideband antenna according to the embodiment of the invention.

FIG. 1A is a pictorial drawing for illustrating a wideband antenna 100 according to an embodiment of the invention. FIG. 1B is a vertical view drawing for illustrating the wideband antenna 100 according to the embodiment of the invention. As shown in FIGS. 1A and 1B, the wideband antenna 100 comprises: a substrate 110, a ground plane 120 (the dotted region), an exciting element 130, a connection element 140, a first branch 150, a second branch 160, and a coupling element 170. The substrate 110 has a first surface E1 and a second surface E2, which is opposite to the first surface E1. The ground plane 120 is disposed on the second surface E2. The exciting element 130 is disposed on the first surface E1, and has a feed point 132, which is electrically coupled to a signal source 134, so as to receive input signals. It is noted that although disposed on the right end of the exciting element 130 as shown in FIGS. 1A and 1B, the feed point 132 may be disposed on the other end, the left end, of the exciting element 130. The connection element 140 is disposed on the first surface E1, and electrically coupled to the ground plane 120 through a metal line 142 (or a via 142). The first branch 150 is disposed on the first surface E1, and electrically coupled to the connection element 140. The second branch 160 is disposed on the first surface E1, and electrically coupled to the connection element 140. The coupling element 170 is disposed on the first surface E1, and electrically coupled to the connection element 140, wherein a first distance D1 between the coupling element 170 and the second branch 160 is smaller than 5 mm. The ground plane 120, the exciting element 130, the connection element 140, the first branch 150, the second branch 160, and the coupling element 170 may be all made of metal, e.g., silver or copper.

In an embodiment of the invention, the exciting element 130 is substantially straight; the connection element 140 is substantially straight; the first branch 150 is substantially U-shaped; and the second branch 160 is substantially U-shaped. With respect to sizes, the substrate 110 has a dielectric constant equal to 4.3 (FR4) and is 1 mm in thickness; the ground plane 120 is approximately 60 mm in width; the exciting element 130 is approximately 27 mm in length; the connection element 140 is approximately 12 mm in length and 3 mm in width; the first branch 150 is approximately 64.5 mm in length; the second branch 160 is approximately 57 mm in length; the coupling element 170 is approximately 7 mm in length; the first distance D1 between the second branch 160 and the coupling element 170 is substantially from 1.2 mm to 3 mm. It is noted that all the element sizes may change in response to different dielectric constants or desired frequency bands.

Figure 2:
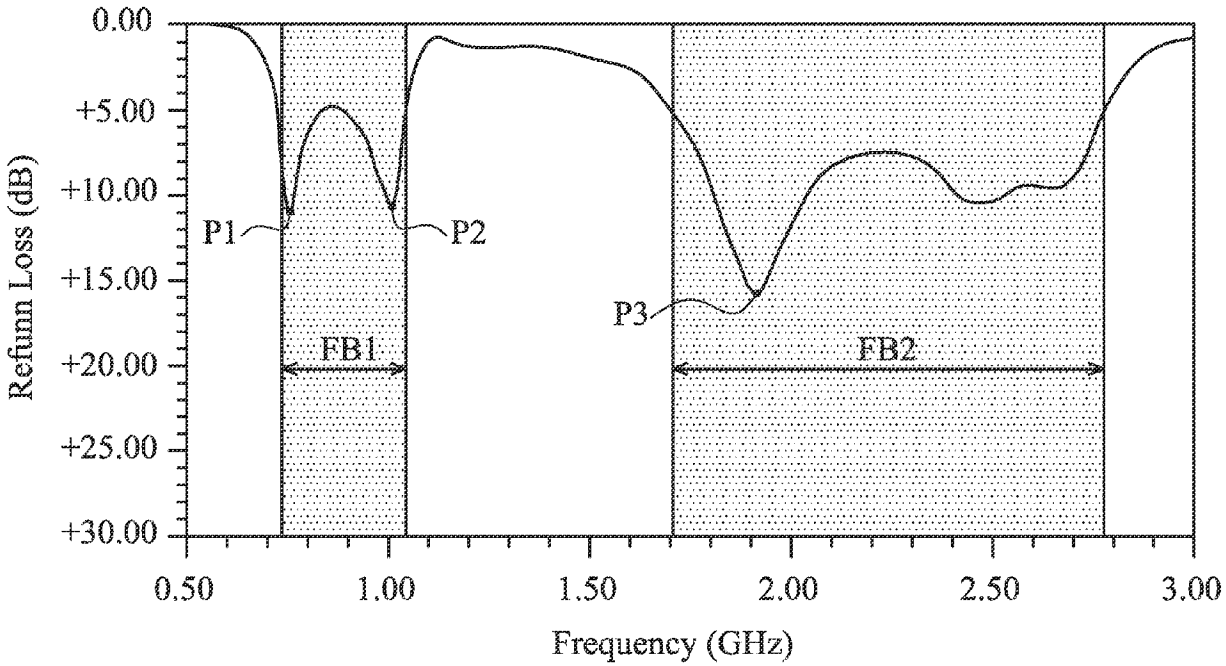
FIG. 2 is a diagram for illustrating return loss of the wideband antenna according to an embodiment of the invention.

FIG. 2 is a diagram for illustrating return loss of the wideband antenna 100 according to an embodiment of the invention. The vertical axis represents return loss (unit: dB), and the horizontal axis represents frequency (unit: GHz). The wideband antenna 100 may cover a first frequency band FB1 and a second frequency band FB2 in response to the criterion set as 5 dB. The exciting element 130, the connection element 140, the first branch 150, the second branch 160, and the coupling element 170 are excited so as to form the first frequency band FB1. More particularly, a frequency point P1 within the first frequency band FB1 is generated by exciting the exciting element 130, the connection element 140 and the first branch 150; and a frequency point P2 within the first frequency band FB1 is generated by exciting the exciting element 130, the connection element 140, the first branch 150, the second branch 160 and the coupling element 170. The exciting element 130 is excited so as to form the second frequency band FB2, and more particularly, a frequency point P3 within the second frequency band FB2 is generated by exciting the exciting element 130. In a preferred embodiment, the first frequency band FB1 is approximately from 730 MHz to 1040 MHz, and the second frequency band FB2 is approximately from 1730 MHz to 2760 MHz.

Figure 3:
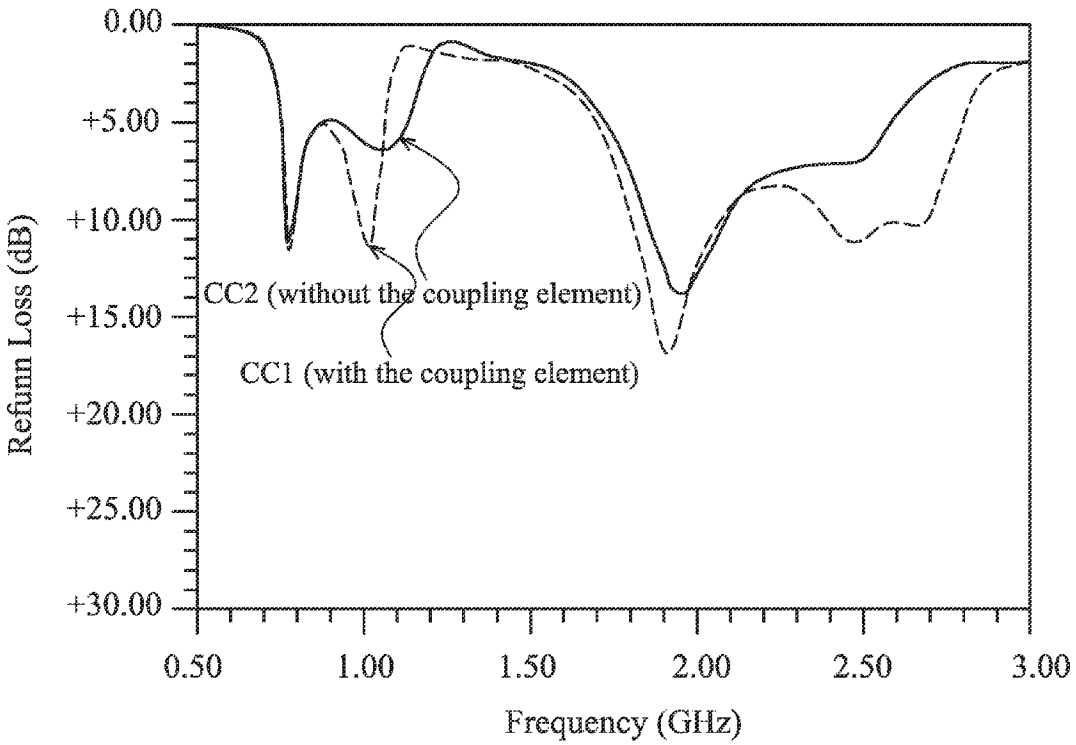
FIG. 3 is a diagram for illustrating return loss of the wideband antenna without the coupling element.

It is noted that the coupling element 170 is utilized for mutual coupling between the connection element 140 and the second branch 160. A past experiment found that removing the coupling element 170 from the wideband antenna causes missing of the frequency point P2 in the diagram of return loss. FIG. 3 is a diagram for illustrating return loss of the wideband antenna 100 without the coupling element 170. There are two curves, CC1 and CC2 in FIG. 3. The curve CC1 represents the return loss of the wideband antenna 100 with the coupling element 170. On the contrary, the curve CC2 represents the return loss of the wideband antenna 100 without the coupling element 170. The curve CC2 does not have the frequency point P2, so the bandwidth is limited.

Figure 4A:
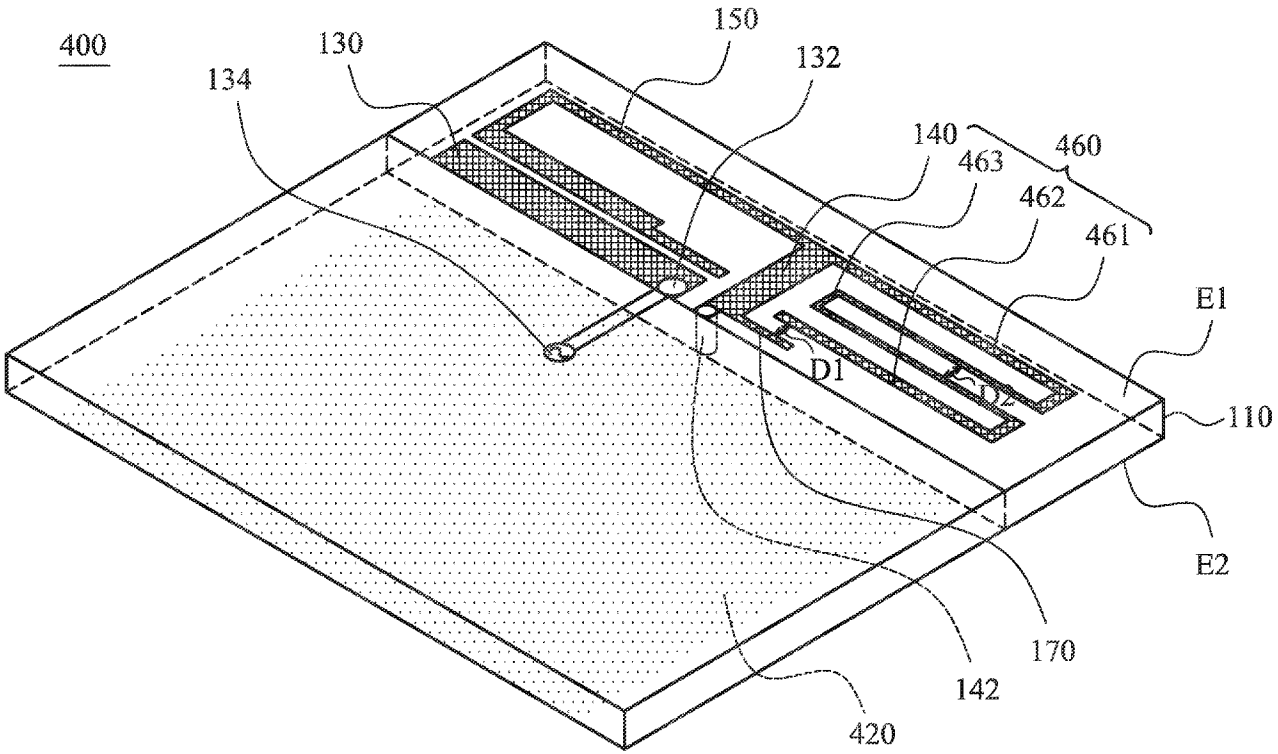
FIG. 4A is a pictorial drawing for illustrating a wideband antenna according to another embodiment of the invention.
Figure 4B:
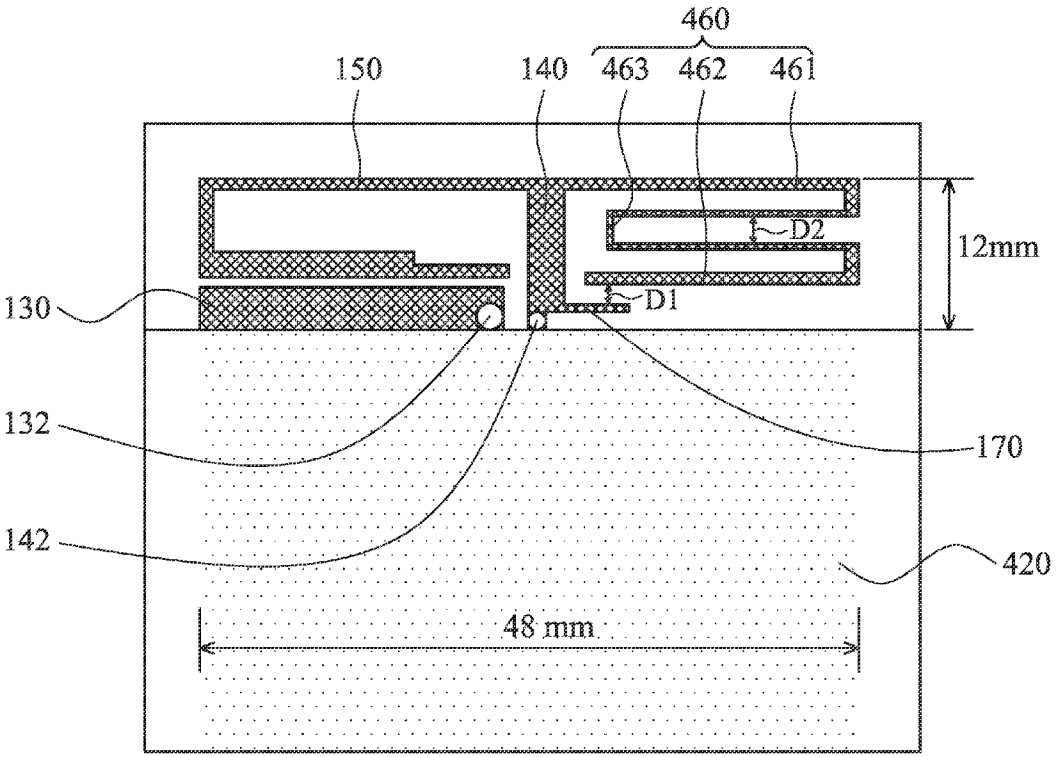
FIG. 4B is a vertical view drawing for illustrating the wideband antenna according to the embodiment of the invention.

FIG. 4A is a pictorial drawing for illustrating a wideband antenna 400 according to another embodiment of the invention. FIG. 4B is a vertical view drawing for illustrating the wideband antenna 400 according to the embodiment of the invention. The wideband antenna 400 is similar to the wideband antenna 100 as shown in FIGS. 1A and 1B; however, the difference between them is that the second branch 160 is replaced with another second branch 460, and the ground plane 120 is replaced with another ground plane 420. As shown in FIGS. 4A and 4B, the second branch 460, coupled to the connection element 140, comprises a first U-shaped portion 461, a second U-shaped portion 462, and a connection piece 463. The second U-shaped portion 462 is electrically coupled to the first U-shaped portion 461 through the connection piece 463. By meandering second branch, the wideband antenna 400 may occupy less area than the wideband antenna 100; therefore, the width of the ground plane 420 can be reduced.

In another embodiment, the substrate 110 has a dielectric constant equal to 4.3 (FR4) and is 1 mm in thickness; the ground plane 420 is approximately 48 mm in width; the exciting element 130 is 26 mm in length; the connection element 140 is approximately 12 mm in length and 4.5 mm in width; the first branch 150 is 62.5 mm in length; the second branch 460 is 63.5 mm in length; the coupling element 170 is 7 mm in length; a first distance D1 between the second branch 460 and the coupling element 170 is substantially from 1.2 mm to 3 mm; a second distance D2 between the first U-shaped portion 461 and the second U-shaped portion 462 is greater than 0.5 mm. It is noted that all the element sizes may change in response to different dielectric constants or desired frequency bands.

Figure 5:
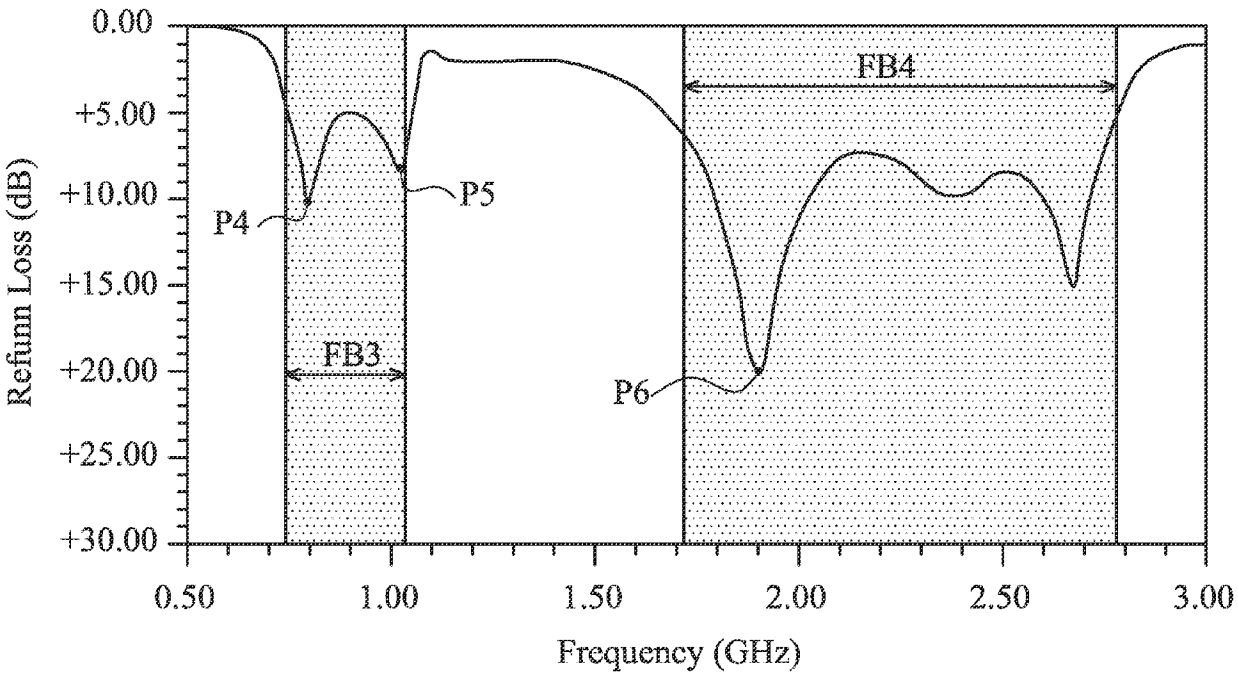
FIG. 5 is a diagram for illustrating return loss of the wideband antenna according to an embodiment of the invention.

FIG. 5 is a diagram for illustrating return loss of the wideband antenna 400 according to an embodiment of the invention. The vertical axis represents return loss (unit: dB), and the horizontal axis represents frequency (unit: GHz). The wideband antenna 400 may cover a third frequency band FB3 and a fourth frequency band FB4 in response to the criterion set as 5 dB. The exciting element 130, the connection element 140, the first branch 150, the second branch 460, and the coupling element 170 are excited so as to form the third frequency band FB3. More particularly, a frequency point P4 within the third frequency band FB3 is generated by exciting the exciting element 130, the connection element 140 and the first branch 150; and a frequency point P5 within the third frequency band FB3 is generated by exciting the exciting element 130, the connection element 140, the first branch 150, the second branch 460 and the coupling element 170. The exciting element 130 is excited so as to form the fourth frequency band FB4, and more particularly, a frequency point P6 within the fourth frequency band FB4 is generated by exciting the exciting element 130. In a preferred embodiment, the third frequency band FB3 is approximately from 750 MHz to 1040 MHz, and the fourth frequency band FB4 is approximately from 1740 MHz to 2750 MHz.

Table I illustrates comparison between the wideband antennas 100 and 400.

TABLE I the comparison between the wideband antennas 100 and 400

| Wideband antenna | Start frequency (MHz) | End frequency (MHz) | Bandwidth (MHz) | Bandwidth (%) |
|---|---|---|---|---|
| 100 (FB1) | 730 | 1040 | 310 | 35.03 |
| 100 (FB2) | 1730 | 2760 | 1030 | 45.88 |
| 400 (FB3) | 750 | 1040 | 290 | 32.40 |
| 400 (FB4) | 1740 | 2750 | 1010 | 44.99 |

As shown in Table I, it is clear that wideband antennas 100 and 400 have similar performance Both of them cover 5 frequency bands, GSM (Global System for Mobile Communications) 850/900/1800/1900 and UMTS (Universal Mobile Telecommunications System) bands. However, the wideband antenna 400 has the small ground plane 420, which is reduced from 60 mm to 48 mm in width, so that the antenna area of the wideband antenna 400 is reduced by 20%.

There may be more adjustments made in the above embodiments. Please refer to FIGS. 6A-6C and FIGS. 7A-7C as follows.

Figure 6A:
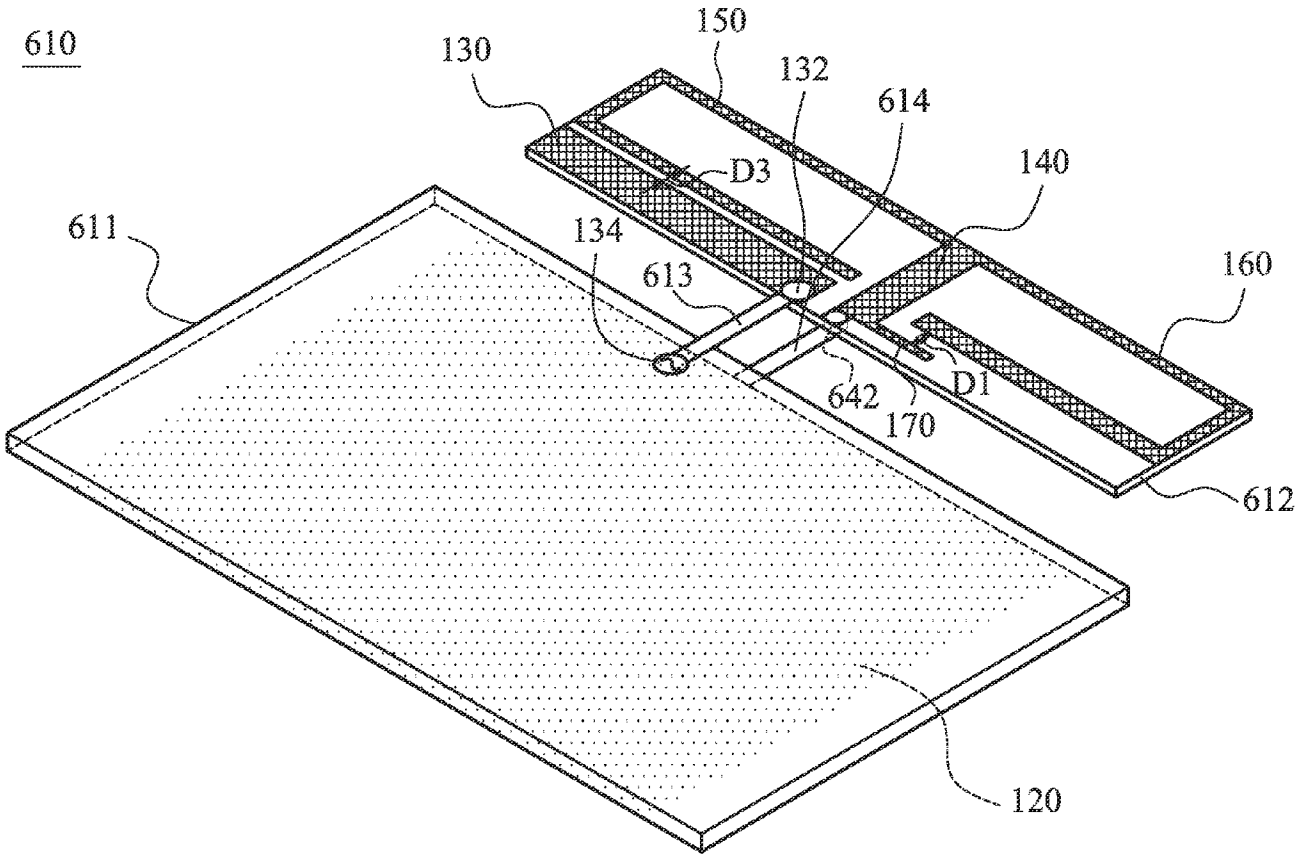
FIG. 6A is a pictorial drawing for illustrating a wideband antenna according to an embodiment of the invention.

FIG. 6A is a pictorial drawing for illustrating a wideband antenna 610 according to an embodiment of the invention. The wideband antenna 610 is similar to the wideband antenna 100 as shown in FIGS. 1A and 1B. The main difference between them is that the wideband antenna 610 further comprises a first substrate 611 and a second substrate 612, instead of the single substrate 110. The second substrate 612 may be completely separate from the first substrate 611. In some embodiments, the first substrate 611 is a system circuit board for accommodating some electronic components (e.g., integrated circuits, capacitors, inductors, and/or resistors), and the second substrate 612 is an FR4 (Flame Retardant 4) substrate or an FPCB (Flexible Printed Circuit Board) for forming a main radiator of the wideband antenna 610. In some embodiments, the total size of the second substrate 612 is much smaller than the total size of the first substrate 611. In some embodiments, the thickness of the second substrate 612 is smaller than the thickness of the first substrate 611. The ground plane 120 may be disposed on a surface or a portion of the first substrate 611. The exciting element 130, the connection element 140, the first branch 150, the second branch 160, and the coupling element 170 may all be disposed on a surface or a portion of the second substrate 612. More particularly, the feed point 132 of the exciting element 130 may be electrically coupled to the signal source 134 through a first metal connection line 613, and the connection element 140 may be electrically coupled to the ground plane 120 through a second metal connection line 614. The first metal connection line 613 and the second metal connection line 614 are arranged for signal transmissions between the first substrate 611 and the second substrate 612, and therefore the function of the wideband antenna 610 is not affected by the separation of the first substrate 611 and the second substrate 612. In some embodiments, the first metal connection line 613 or the second metal connection line 614 comprises a conductive via 642 formed through the second substrate 612. The wideband antenna 610 may have a coupled-fed structure. In some embodiments, to form the coupled-fed structure, a third distance D3 between the exciting element 130 and the first branch 150 is smaller than 5 mm, and the mutual coupling therebetween is enhanced accordingly. Other features of the wideband antenna 610 of FIG. 6A are the same as those of the wideband antenna 100 of FIG. 1A and FIG. 1B. As a result, the two embodiments can achieve similar performances.

Figure 6B:
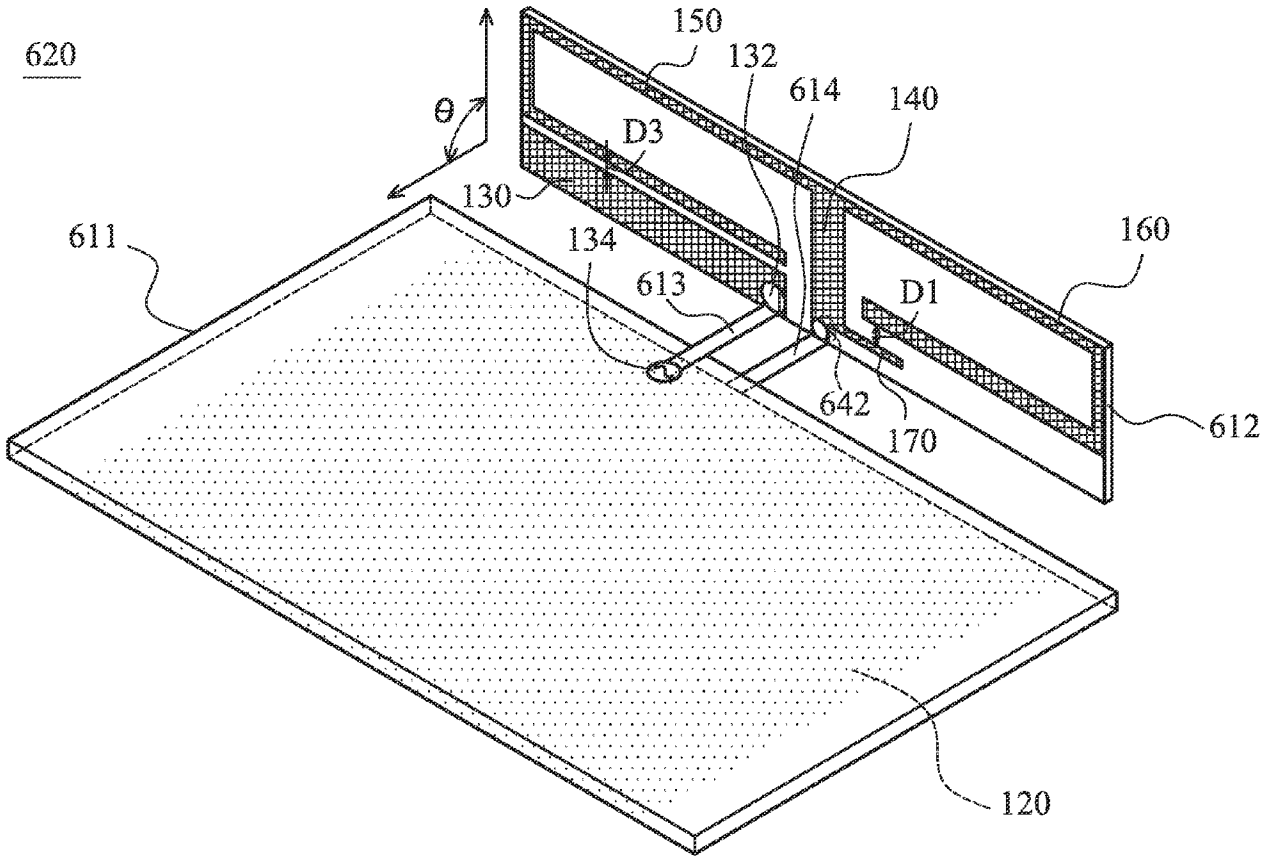
FIG. 6B is a pictorial drawing for illustrating a wideband antenna according to another embodiment of the invention.

In the embodiment of FIG. 6A, the second substrate 612 is substantially parallel to the first substrate 611. It is understood that the invention is not limited to the above. FIG. 6B is a pictorial drawing for illustrating a wideband antenna 620 according to another embodiment of the invention. As shown in FIG. 6B, in the wideband antenna 620, the second substrate 612 is not parallel to the first substrate 611. An included angle θ between the second substrate 612 and the first substrate 611 may not be restricted, and for example, may be from 0 to 180 degrees. In some embodiments, the included angle θ is substantially equal to 90 degrees; that is, the second substrate 612 is substantially perpendicular to the first substrate 611, but it is not limited thereto. The included angle θ may be appropriately adjusted by a designer according to different requirements. For example, the shape of the wideband antenna 620 may be changed by adjusting the included angle θ, and therefore the wideband antenna 620 may fit different housings of mobile devices. Other features of the wideband antenna 620 of FIG. 6B are the same as those of the wideband antenna 610 of FIG. 6A. As a result, the two embodiments can achieve similar performances.

Figure 6C:
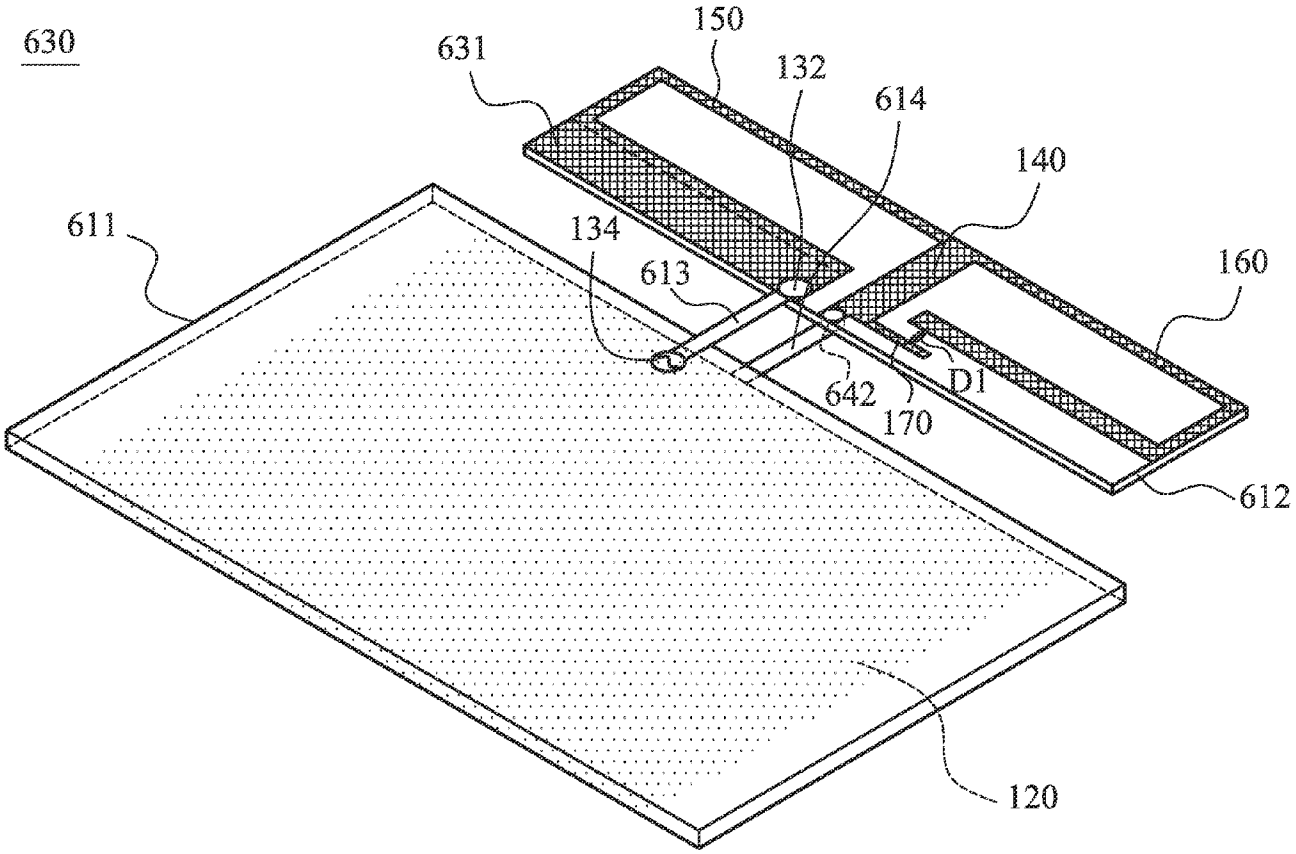
FIG. 6C is a pictorial drawing for illustrating a wideband antenna according to an embodiment of the invention.

FIG. 6C is a pictorial drawing for illustrating a wideband antenna 630 according to an embodiment of the invention. As shown in FIG. 6C, in the wideband antenna 630, adjustments are made such that an exciting element 631 is directly connected to the first branch 150. That is, the aforementioned coupled-fed structure of FIG. 6A and FIG. 6B is replaced with a directly-fed structure of FIG. 6C, and the third distance D3 between the exciting element 631 and the first branch 150 is reduced to zero. Since the main resonant paths of the wideband antenna 630 are kept almost unchanged, the performance of the wideband antenna 630 is not affected by the replacement of the coupled-fed structure with the directly-fed structure. Other features of the wideband antenna 630 of FIG. 6C are the same as those of the wideband antenna 610 of FIG. 6A. As a result, the two embodiments can achieve similar performances.

Figure 7A:
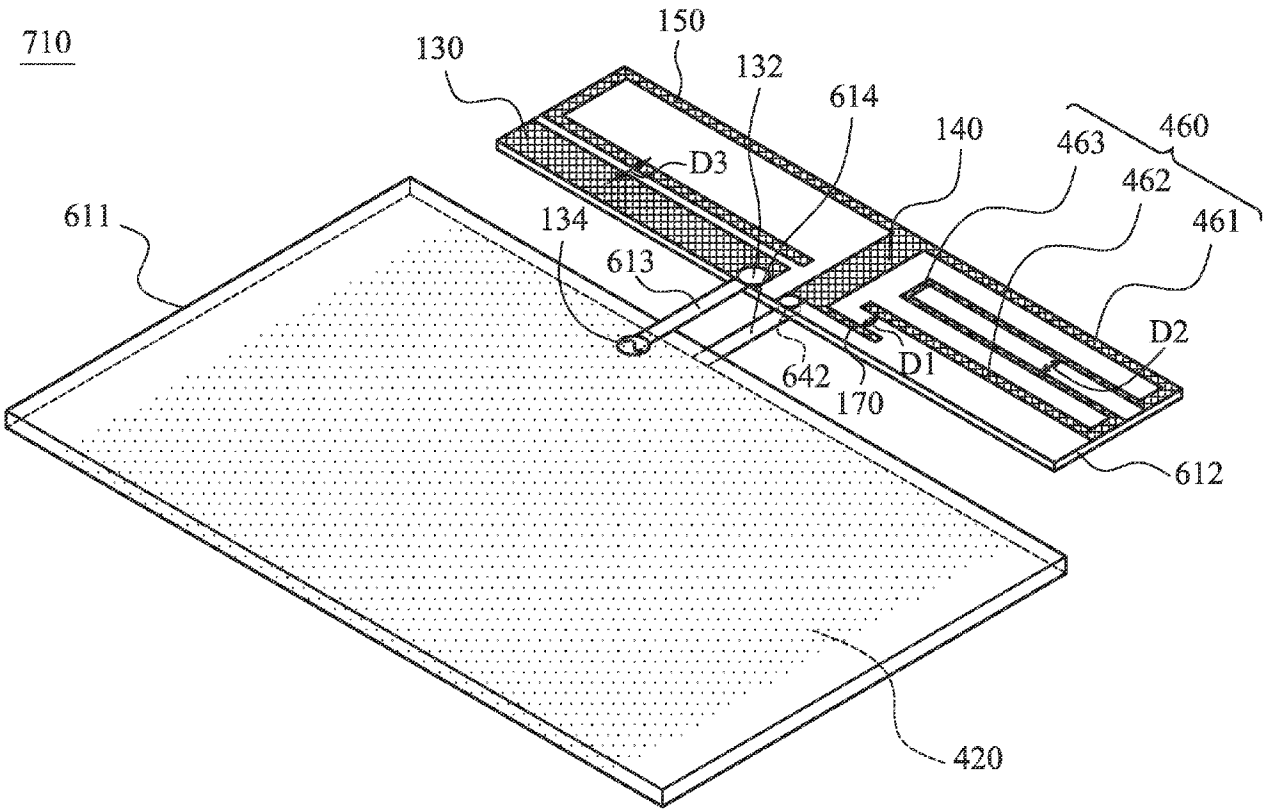
FIG. 7A is a pictorial drawing for illustrating a wideband antenna according to an embodiment of the invention.

FIG. 7A is a pictorial drawing for illustrating a wideband antenna 710 according to an embodiment of the invention. The wideband antenna 710 is similar to the wideband antenna 400 as shown in FIGS. 4A and 4B. The main difference between them is that the wideband antenna 710 further comprises a first substrate 611 and a second substrate 612, instead of the single substrate 110. The second substrate 612 may be completely separate from the first substrate 611. In some embodiments, the first substrate 611 is a system circuit board for accommodating some electronic components (e.g., integrated circuits, capacitors, inductors, and/or resistors), and the second substrate 612 is an FR4 substrate or an FPCB for forming a main radiator of the wideband antenna 710. In some embodiments, the total size of the second substrate 612 is much smaller than the total size of the first substrate 611. In some embodiments, the thickness of the second substrate 612 is smaller than the thickness of the first substrate 611. The ground plane 420 may be disposed on a surface or a portion of the first substrate 611. The exciting element 130, the connection element 140, the first branch 150, the second branch 460, and the coupling element 170 may all be disposed on a surface or a portion of the second substrate 612. More particularly, the feed point 132 of the exciting element 130 may be electrically coupled to the signal source 134 through a first metal connection line 613, and the connection element 140 may be electrically coupled to the ground plane 420 through a second metal connection line 614. The first metal connection line 613 and the second metal connection line 614 are arranged for signal transmissions between the first substrate 611 and the second substrate 612, and therefore the function of the wideband antenna 710 is not affected by the separation of the first substrate 611 and the second substrate 612. In some embodiments, the first metal connection line 613 or the second metal connection line 614 comprises a conductive via 642 formed through the second substrate 612. The wideband antenna 710 may have a coupled-fed structure. In some embodiments, to form the coupled-fed structure, a third distance D3 between the exciting element 130 and the first branch 150 is smaller than 5 mm, and the mutual coupling therebetween is enhanced accordingly. Other features of the wideband antenna 710 of FIG. 7A are the same as those of the wideband antenna 400 of FIG. 4A and FIG. 4B. As a result, the two embodiments can achieve similar performances.

Figure 7B:
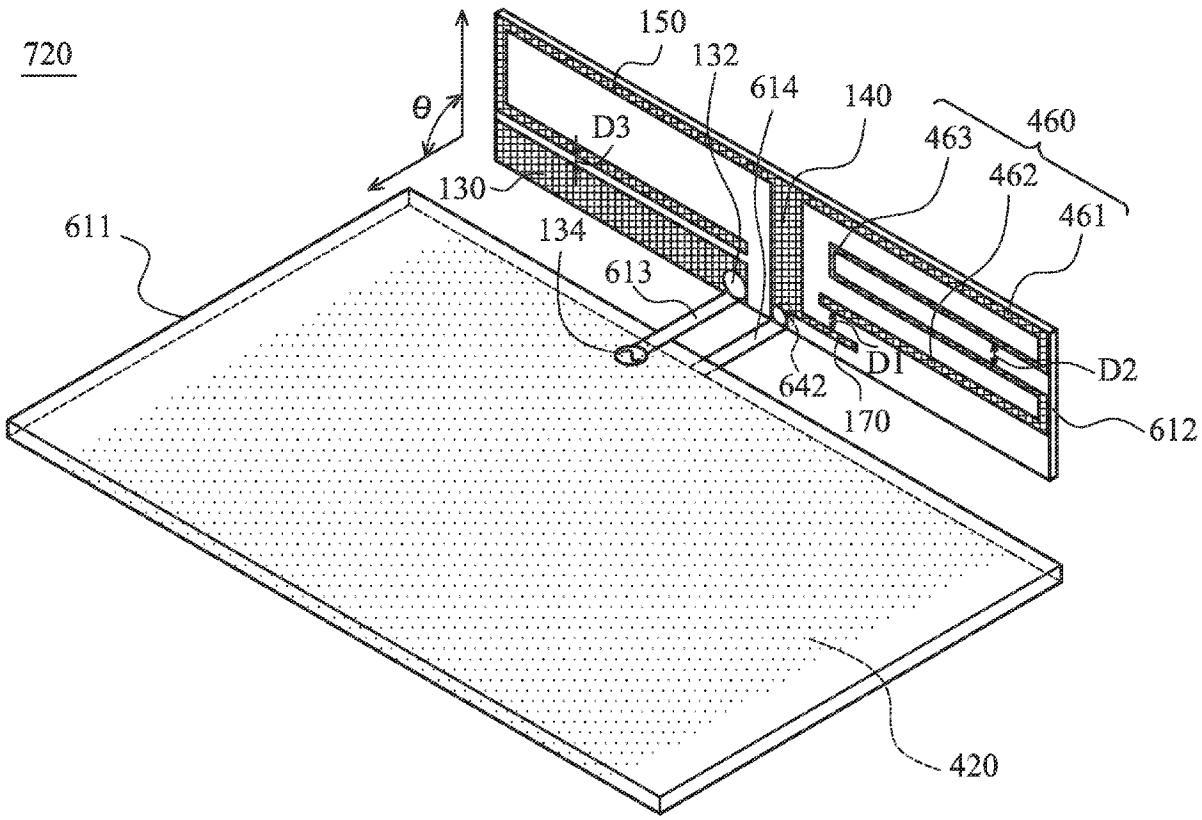
FIG. 7B is a pictorial drawing for illustrating a wideband antenna according to another embodiment of the invention.

In the embodiment of FIG. 7A, the second substrate 612 is substantially parallel to the first substrate 611. It is understood that the invention is not limited to the above. FIG. 7B is a pictorial drawing for illustrating a wideband antenna 720 according to another embodiment of the invention. As shown in FIG. 7B, in the wideband antenna 720, the second substrate 612 is not parallel to the first substrate 611. An included angle θ between the second substrate 612 and the first substrate 611 may not be restricted, and for example, may be from 0 to 180 degrees. In some embodiments, the included angle θ is substantially equal to 90 degrees; that is, the second substrate 612 is substantially perpendicular to the first substrate 611, but it is not limited thereto. The included angle θ may be appropriately adjusted by a designer according to different requirements. For example, the shape of the wideband antenna 720 may be changed by adjusting the included angle θ, and therefore the wideband antenna 720 may fit different housings of mobile devices. Other features of the wideband antenna 720 of FIG. 7B are the same as those of the wideband antenna 710 of FIG. 7A. As a result, the two embodiments can achieve similar performances.

Figure 7C:
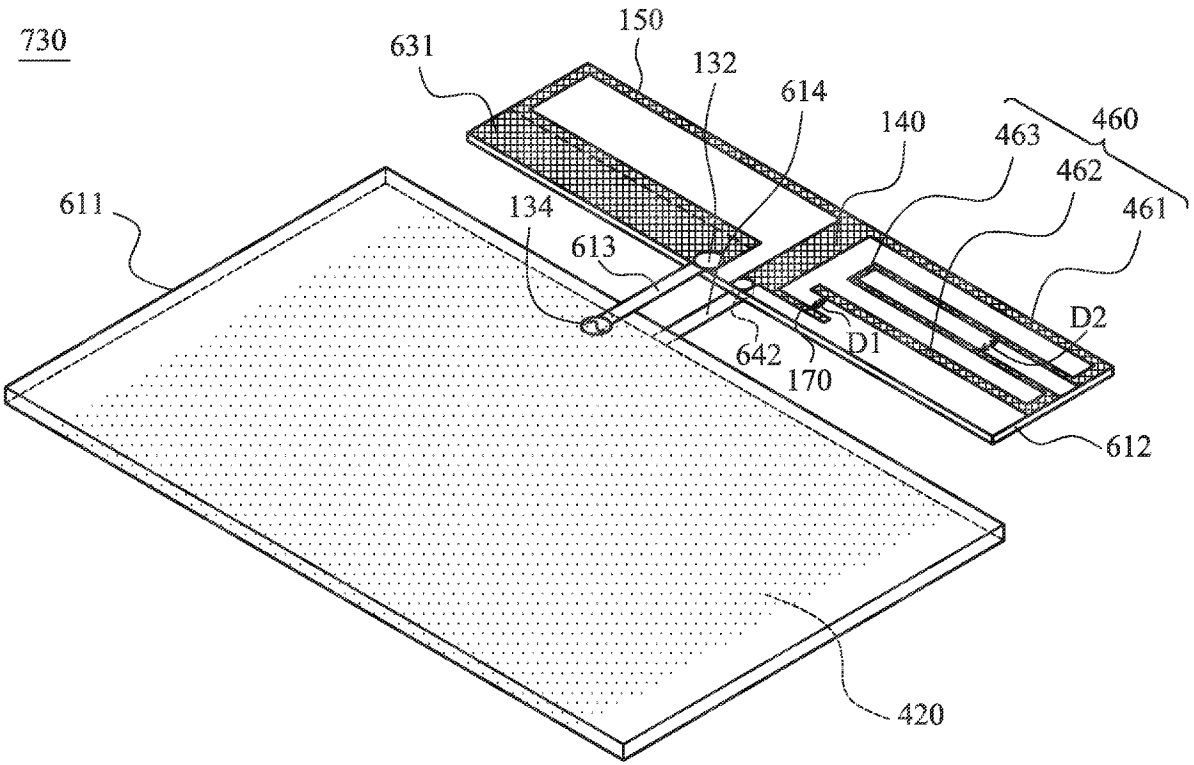
FIG. 7C is a pictorial drawing for illustrating a wideband antenna according to an embodiment of the invention.

FIG. 7C is a pictorial drawing for illustrating a wideband antenna 730 according to an embodiment of the invention. As shown in FIG. 7C, in the wideband antenna 730, adjustments are made such that an exciting element 631 is directly connected to the first branch 150. That is, the aforementioned coupled-fed structure of FIG. 7A and FIG. 7B is replaced with a directly-fed structure of FIG. 7C, and the third distance D3 between the exciting element 631 and the first branch 150 is reduced to zero. Since the main resonant paths of the wideband antenna 730 are kept almost unchanged, the performance of the wideband antenna 730 is not affected by the replacement of the coupled-fed structure with the directly-fed structure. Other features of the wideband antenna 730 of FIG. 7C are the same as those of the wideband antenna 710 of FIG. 7A. As a result, the two embodiments can achieve similar performances.

The invention provides the wideband antennas for operating in 5 frequency bands, GSM 850/900/1800/1900 and UMTS. Furthermore, the antenna area can be reduced to 48 mm by 12 mm, which is a very small area. These wideband antennas can be applied to a variety of mobile devices, for example, cellular phones, tablet PC (Tablet Personal Computer), or notebooks.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A wideband antenna, comprising:
- a first substrate;
- a second substrate;
- a ground plane, disposed on the first substrate;
- an exciting element, disposed on the second substrate, and having a feed point coupled to a signal source;
- a connection element, disposed on the second substrate, and coupled to the ground plane;
- a first branch, disposed on the second substrate, and coupled to the connection element;
- a second branch, disposed on the second substrate, and coupled to the connection element; and
- a coupling element, disposed on the second substrate, and coupled to the connection element,
- wherein a first distance between the coupling element and the second branch is smaller than 5 mm.

2. The wideband antenna as claimed in claim 1, wherein the first substrate is a system circuit board.

3. The wideband antenna as claimed in claim 1, wherein the second substrate is separate from the first substrate.

4. The wideband antenna as claimed in claim 1, wherein a total size of the second substrate is much smaller than a total size of the first substrate.

5. The wideband antenna as claimed in claim 1, wherein the second substrate is substantially parallel to the first substrate.

6. The wideband antenna as claimed in claim 1, wherein the second substrate is not parallel to the first substrate.

7. The wideband antenna as claimed in claim 6, wherein the second substrate is substantially perpendicular to the first substrate.

8. The wideband antenna as claimed in claim 1, wherein the exciting element is substantially straight.

9. The wideband antenna as claimed in claim 1, wherein the connection element is substantially straight.

10. The wideband antenna as claimed in claim 1, wherein the first branch is substantially U-shaped.

11. The wideband antenna as claimed in claim 1, wherein the first distance is substantially from 1.2 mm to 3 mm.

12. The wideband antenna as claimed in claim 1, wherein the second branch is substantially U-shaped.

13. The wideband antenna as claimed in claim 1, wherein the exciting element, the connection element, the first branch, the second branch, and the coupling element are excited so as to form a first frequency band.

14. The wideband antenna as claimed in claim 13, wherein the first frequency band is approximately from 730 MHz to 1040 MHz.

15. The wideband antenna as claimed in claim 1, wherein the exciting element is excited so as to form a second frequency band.

16. The wideband antenna as claimed in claim 15, wherein the second frequency band is approximately from 1730 MHz to 2760 MHz.

17. The wideband antenna as claimed in claim 1, wherein the second branch comprises:
- a first U-shaped portion;
- a connection piece; and
- a second U-shaped portion, coupled to the first U-shaped portion through the connection piece.

18. The wideband antenna as claimed in claim 17, wherein a second distance between the first and second U-shaped portions is greater than 0.5 mm.

19. The wideband antenna as claimed in claim 1, wherein a third distance between the exciting element and the first branch is smaller than 5 mm.

20. The wideband antenna as claimed in claim 19, wherein the exciting element is directly connected to the first branch, and the third distance is reduced to zero.

* * * * *